US005367788A

United States Patent [19]

Chen

[11] Patent Number: 5,367,788

[45] Date of Patent: Nov. 29, 1994

[54] SHOE WITH A BUILT-IN COOLING APPARATUS

[76] Inventor: Shi-Hiu Chen, 5F, No. 564, Sec. 1, Chung-Te Rd., Taichung, Taiwan, Prov. of China

[21] Appl. No.: 167,014

[22] Filed: Dec. 16, 1993

[51] Int. Cl.[5] ..... A43B 7/04; A43B 7/08

[52] U.S. Cl. ..... 36/3 B; 36/26; 62/3.5

[58] Field of Search ..... 36/2.6, 3 R, 3 B; 62/3.5, 3.2

[56] References Cited

U.S. PATENT DOCUMENTS

| | | | |
|---|---|---|---|
| 2,720,041 | 10/1955 | Kajjar | 36/3 B |
| 3,648,469 | 3/1972 | Chapman | 62/3.5 |
| 3,648,470 | 3/1972 | Schultz | 62/3.5 |
| 4,078,321 | 3/1978 | Famorare, Jr. | 36/3 B |
| 4,470,263 | 9/1984 | Lehovec et al. | 62/3.5 |
| 4,782,602 | 11/1988 | Lakic | 36/2.6 |
| 4,800,867 | 1/1989 | Owens | 36/2.6 |
| 4,888,887 | 12/1989 | Solow | 36/3 R |
| 5,167,082 | 12/1992 | Chen | 36/2.6 |
| 5,196,294 | 3/1993 | Galvin et al. | 62/3.5 |

*Primary Examiner*—Steven N. Meyers

*Attorney, Agent, or Firm*—Sughrue, Mion, Zinn, Macpeak and Seas

[57] ABSTRACT

A shoe includes a shoe sole having an accommodating portion and several ventilation holes formed through the side wall of the accommodating portion. A pressure-operated electric generator is provided in the accommodating portion and produces a voltage signal when pressure is repeatedly applied on the shoe sole during use. A cooling apparatus is provided inside the accommodating portion and produces cold air when the electric generator supplies the voltage signal to the cooling apparatus so as to cool the foot of a user. An air permeable and waterproof cloth covers the top surface of the shoe sole and surrounds the electric generator and the cooling apparatus except for the top surfaces of the same. A middle sole covers the upper portion of the assembly of the shoe sole and the cloth and has an accommodating hole formed therethrough so as to allow the top surface of the cooling apparatus to extend through the accommodating hole. A shoe pad is disposed on the top surface of the middle sole. Each of the middle sole and the shoe pad has several holes formed therethrough and communicated with the ventilation holes of the shoe sole in order to facilitate circulation of air in the shoe.

2 Claims, 3 Drawing Sheets

SHOE WITH A BUILT-IN COOLING APPARATUS

BACKGROUND OF THE INVENTION

1. Field of the Invention

This invention relates to a shoe, more particularly to a shoe which has a cooling apparatus that is placed in the shoe sole and that can produce cold air so as to cool the foot of a user and provide a comfortable feeling for the user when the shoe is in use.

2. Description of the Related Art

Generally speaking, conventional shoes are manufactured not only to satisfy an aesthetic need but also to achieve a comfortable feeling for the consumer. Accordingly, most shoes have several ventilation holes formed through the side wall of the shoe sole and the vamp of the shoe so as to allow or cause fresh air to enter and flow around the inner portion of the shoe, thus driving out foul air.

However, even if the ventilation holes of the shoe can permit fresh air to enter the inner portion of the shoe, there is still a heavy wet air inside the shoe due to moist weather condition or due to sweating of the foot. As a result, the user feels uncomfortable when the conventional shoe is in use.

SUMMARY OF THE INVENTION

The main objective of this invention is to provide a shoe which has a cooling apparatus that is placed in the shoe sole and that can produce cold air during use so as to cool the foot of a user and prevent a muggy feeling to the user.

According to this invention, the shoe includes a shoe sole, a pressure-operated electric generator, a cooling apparatus, an air permeable and waterproof cloth, a middle sole, and a shoe pad. The shoe sole has an accommodating portion with a bottom wall, a plurality of ventilation holes formed through the side wall of the accommodating portion, and a plurality of upright partitions secured on the bottom wall of the accommodating portion so as to divide the accommodating portion into several compartments. Each of the upright partitions has a notch formed in the upper end portion thereof so that any adjacent pair of the compartments are communicated with each other via one of the notches. The pressure-operated electric generator is provided inside one of the compartments near the heel portion of the shoe sole and produces a voltage signal when pressure is repeatedly applied on the shoe sole during use. The cooling apparatus is provided inside one of the compartments near the tip portion of the shoe sole and is connected electrically to the electric generator so as to produce cold air to cool the foot of a user when the electric generator supplies the voltage signal to the cooling apparatus. The air permeable and waterproof cloth covers completely the top surface of the shoe sole and is provided to surround the electric generator and the cooling apparatus except for the top surface of the cooling apparatus and the top surface of the electric generator so as to prevent the cooling apparatus and the electric generator from being accessed by water from the exterior of the shoe via the ventilation holes of the shoe sole. The middle sole covers completely the upper portion of the assembly of the accommodating portion of the shoe sole and the cloth and has several ventilation holes formed therethrough and communicated with the compartments respectively. An accommodating hole is formed through the middle sole near the tip portion of the shoe sole so as to allow the top surface of the cooling apparatus to extend through the accommodating hole of the middle sole. The shoe pad is disposed on the top surface of the middle sole and has several holes formed therethrough. Each of the holes of the shoe pad is communicated with a respective one of the ventilation holes of the middle sole.

Accordingly, the cold air produced by the cooling apparatus is capable of entering the interior of the shoe via the accommodating hole of the middle sole and the holes of the shoe pad in order to cool the foot of the user. The foul air in the shoe can be driven out through the ventilation holes of the shoe sole via the holes of the shoe pad and the ventilation holes of the middle sole.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THIS INVENTION

Figure 1:
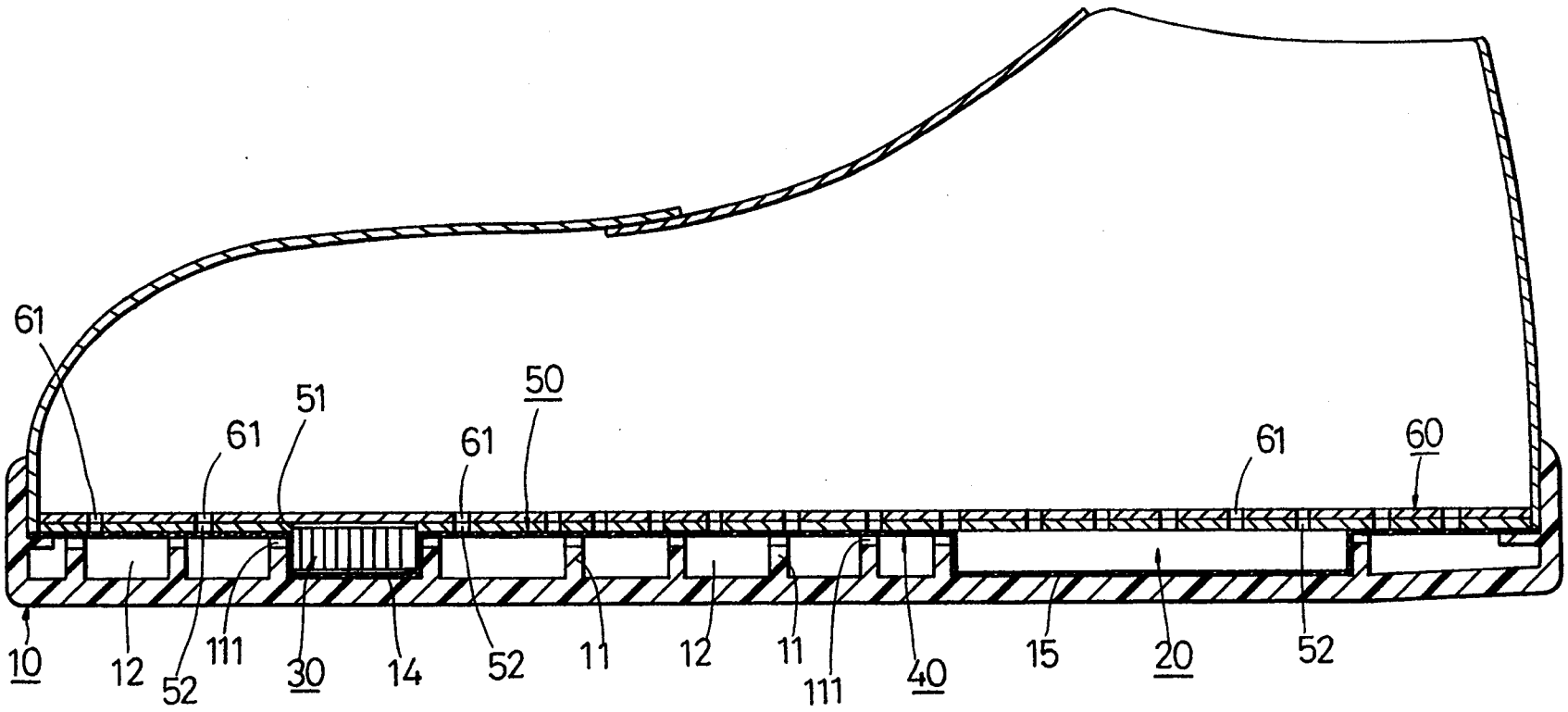
FIG. 1 is a sectional view showing a shoe of the preferred embodiment of this invention which includes a shoe sole, a pressure-operated electric generator, a cooling apparatus, an air permeable and waterproof cloth, a middle sole, and a shoe pad.

Referring to FIG. 1, the shoe of the preferred embodiment of this invention includes a shoe sole 10, a pressure-operated electric generator 20, a cooling apparatus 30, an air permeable and waterproof cloth 40, a middle sole 50, and a shoe pad 60.

Figure 2:
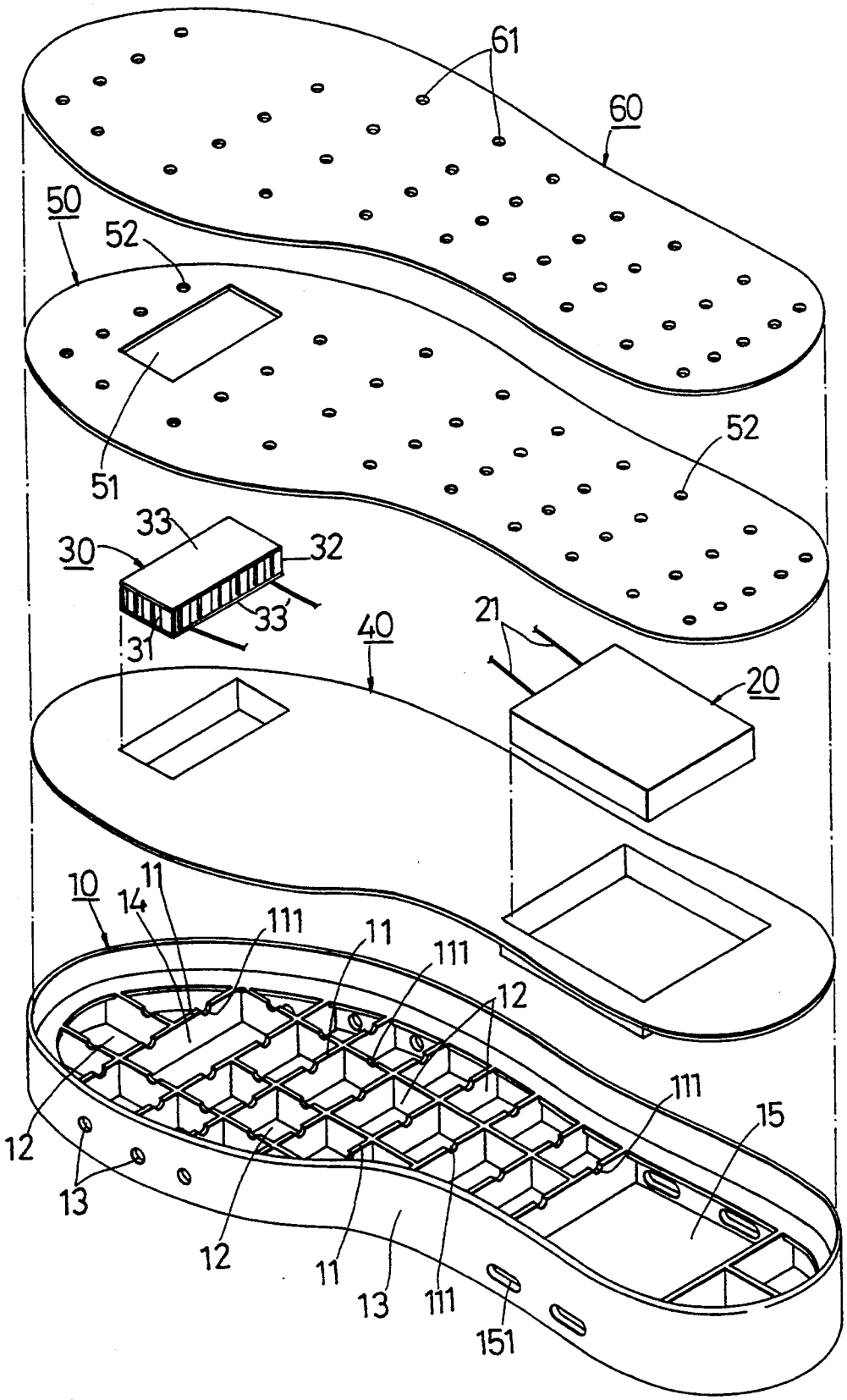
FIG. 2 is an exploded view showing the shoe pad, the middle sole, the air permeable and waterproof cloth, the cooling apparatus, and the electric generator, and the shoe sole.

Referring to FIG. 2, the shoe sole 10 has an accommodating portion with a bottom wall. A plurality of upright partitions 11 are mounted securely on the bottom wall of the accommodating portion so as to divide the accommodating portion into a middle-size compartment 14, a large compartment 15, and several small compartments 12. The large compartment 15 is located at a position adjacent to the heel portion of the shoe sole 10. The middle-size compartment 14 is located at a position adjacent to the tip portion of the shoe sole 10. Each of the upright partitions 11 has a notch 111 formed in the upper end portion thereof. Accordingly, any adjacent pair of the compartments 12, 14, 15 are communicated with each other via one of the notches 111. A plurality of ventilation holes 13 are formed through the side wall of the accommodating portion near the tip portion of the shoe sole 10. Two pairs of ventilation slots 151 are formed through the side wall of the accommodating portion near the heel portion of the shoe sole 10. The ventilation holes 13 and slots 151 enable the compartments 12, 14, 15 to communicate with the exterior of the shoe.

The pressure-operated electric generator 20 is provided inside the compartment 15 near the heel portion of the shoe sole 10 and is capable of producing a voltage signal in a known manner. Accordingly, when pressure is repeatedly applied on the shoe sole 10 during use, the electric generator 20 can produce the voltage signal. At the same time, the electric generator 20 produces hot air due to motion of the electric generator 20. The hot air is capable of flowing from the shoe sole 10 through the ventilation slots 151.

The cooling apparatus 30 is provided inside the compartments 14 and includes an insulating upper horizontal plate 33, an insulating lower horizontal plate 33' which is placed on the bottom wall of the accommodating portion, and a semiconductor device which is connected electrically to two electric wires 21 of the electric generator 20.

Figure 3:
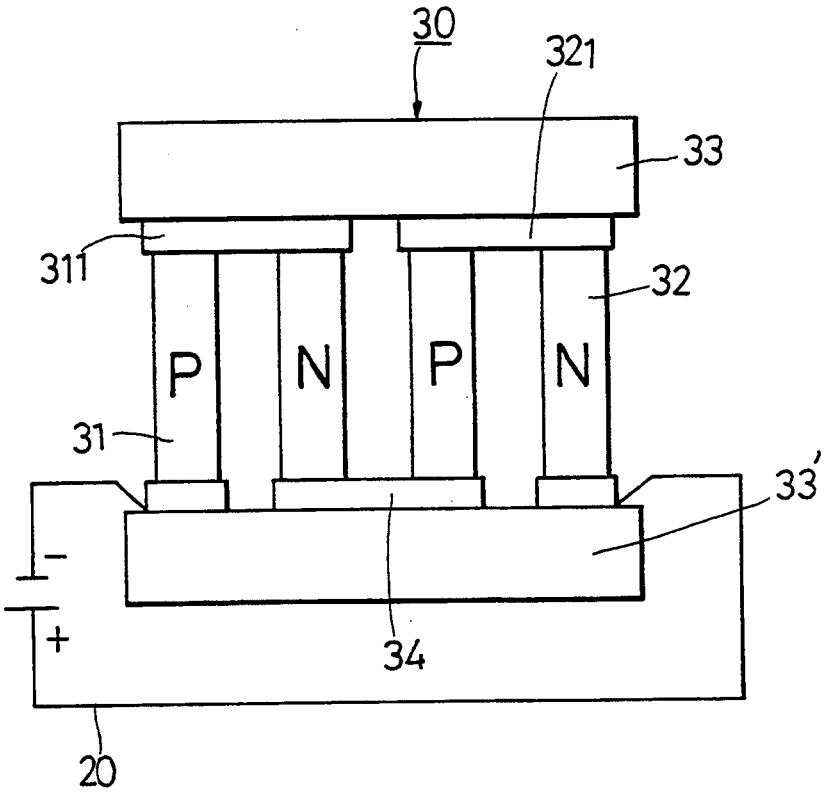
FIG. 3 is a schematic view illustrating the connection of the cooling apparatus and the electric generator according to this invention.

The semiconductor device, as shown in FIG. 3, includes two pairs of p-n junctions 31, 32 that are connected in series with each other and that are mounted securely between the upper and lower horizontal plates 33, 33'. The depletion regions 311, 321 of the p-n junctions 31, 32 are adjacent to the upper horizontal plate 30. Because negative voltage of the electric generator 20 is applied to the p-side of the p-n junction 31 with respect to the n-side of the p-n junction 32, the p-n junctions 31, 32 become reverse-biased and the total electrostatic potential across the p-n junctions 31, 32 is increased. Note that the reverse-biased condition increases the energy band width of the depletion regions 311, 321 of the p-n junctions 31, 32. As a result, the corresponding potential energy of the n-side is far higher than that of the p-side. Accordingly, when electrons produced by the electric generator 20 pass through the depletion regions 311, 321 of the p-n junctions 31, 32, they absorb heat from air adjacent to the cooling apparatus 30. In this way, cold air is produced above the upper horizontal plate 33 of the cooling apparatus 30 so as to cool the foot of a user.

By contrast, when the electrons move from the n-side of the p-n junction 31 to the p-side of the p-n junction 32 via a conductor plate 34, the semiconductor device produces hot air around the lower horizontal plate 33' due to heat emission of the electrons so as to achieve the law of conservation of energy. The hot air is ejected outward from the ventilation holes 13 of the shoe sole 10 (see FIG. 2).

Again referring to FIGS. 1 and 2, the air permeable and waterproof cloth 40 covers completely the top surface of the shoe sole 10 and surrounds the electric generator 20 and the cooling apparatus 30 except for the top surface of the cooling apparatus 30 and the top surface of the electric generator 20 so as to prevent the cooling apparatus 30 and the electric generator 20 from being accessed by water from the exterior of the shoe via the ventilation holes of the shoe sole, but allow the hot air produced by the cooling apparatus 30 and the electric generator 20 to pass therethrough, thereby driving out the hot air from the inside of the shoe through the ventilation holes 13 and the ventilation slots 151 of the shoe sole 10.

The middle sole 50 covers completely the upper portion of the assembly of the accommodating portion of the shoe sole 10 and the cloth 40 and has several ventilation holes 52 formed therethrough and communicated with the compartments 12, 14, 15 respectively. An accommodating hole 51 is formed in the middle sole 50 near the tip portion of the shoe sole 10 so as to allow the top surface of the cooling apparatus 30 to extend through the accommodating hole 51 of the middle sole 50.

The shoe pad 60 is disposed on the top surface of the middle sole 50 and has several holes 61 formed therethrough. The holes 61 of the shoe pad 60 are communicated with the accommodating hole 51 and the ventilation holes 52 of the middle sole 50. Accordingly, the cold air produced by the cooling apparatus 30 enters the interior of the shoe via the accommodating hole 51 of the middle sole 50 and the holes 61 of the shoe pad 60 so as to cool the foot of the user. Then, the foul air in the shoe can be driven out through the ventilation holes 13 and the ventilation slots 151 (see FIG. 2) of the shoe sole 10 because the ventilation holes 13 and ventilation slots 151 are communicated with the holes 61 of the shoe pad 60 and the ventilation holes 52 of the middle sole 50.

Moreover, when the foot of the user sweats while the present invention is in use, the cold air produced by the cooling apparatus 30 can quickly and effectively dehydrate the interior of the shoe, thereby providing the user with a comfortable feeling while preventing the breeding of bacteria inside the shoe.

With this invention thus explained, it is apparent that numerous modifications and variations can be made without departing from the scope and spirit of this invention. It is therefore intended that this invention be limited only as indicated in the appended claims.

I claim:

1. A shoe, comprising:

a shoe sole having an accommodating portion with a bottom wall, a plurality of ventilation holes formed through a side wall of said accommodating portion, and a plurality of upright partitions secured on said bottom wall of said accommodating portion so as to divide said accommodating portion into several compartments, each of said upright partitions having a notch formed in an upper end portion thereof so that any adjacent pair of said compartments are communicated with each other via one of said notches;

a pressure-operated electric generator provided inside one of said compartments which is adjacent to a heel portion of said shoe sole, said electric generator producing a voltage signal when pressure is repeatedly applied on said shoe sole during use;

a cooling apparatus provided inside one of said compartments which is adjacent to a tip portion of said shoe sole and connected electrically to said electric generator, said cooling apparatus producing a cold air so as to cool a foot of a user when said electric generator supplies said voltage signal to said cooling apparatus;

an air permeable and waterproof cloth covering completely a top surface of said shoe sole and surrounding said electric generator and said cooling apparatus except for a top surface of said cooling apparatus and a top surface of said electric generator so as to prevent said cooling apparatus and said electric generator from being accessed by water from exterior of said shoe via said ventilation holes;

a middle sole covering completely an upper portion of assembly of said accommodating portion of said shoe sole and having several ventilation holes formed therethrough and communicated with said compartments respectively, and an accommodating hole formed through said middle sole near said tip portion of said shoe sole so as to allow said top surface of said cooling apparatus to extend through said accommodating hole of said middle sole; and a shoe pad being disposed on a top surface of said middle sole and having several holes formed therethrough, each of said holes of said shoe pad being communicated with a respective one of said ventilation holes of said middle sole.

2. A shoe as claimed in claim 1, wherein said cooling apparatus includes an insulating upper horizontal plate, an insulating lower horizontal plate, and a semiconductor device secured between said upper and lower horizontal plates and connected electrically to said electric generator by means of a reverse-biased p-n junction, a depletion region of said p-n junction being adjacent to said upper horizontal plate of said cooling apparatus;

whereby, when electrons produced by said electric generator pass through said depletion region of said p-n junction, the electrons absorb heat from air adjacent to said cooling apparatus so as to produce said cold air above said upper horizontal plate.

* * * * *